US005879001A

United States Patent [19]

Perego

[11] Patent Number: 5,879,001

[45] **Date of Patent: *Mar. 9, 1999**

[54] UNIT AND METHOD FOR INDIVIDUALLY FEEDING BROCHURES TO A PICK-UP STATION

[75] Inventor: Luciano Perego, Milan, Italy

[73] Assignee: Tapematic U.S.A., Inc., Orlando, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 589,087

[22] Filed: Jan. 23, 1996

[30] Foreign Application Priority Data

Mar. 31, 1995 [EP] European Pat. Off. ..... 95830130.1

[51] Int. Cl.[6] ..... B65H 5/00

[52] U.S. Cl. ..... 271/10.07; 271/35; 271/157

[58] Field of Search ..... 271/10.06, 10.07, 271/10.08, 34, 35, 157

[56] References Cited

U.S. PATENT DOCUMENTS

| | | | |
|---|---|---|---|
| 3,086,772 | 4/1963 | Vogel | 371/35 |
| 3,118,663 | 1/1964 | Logan | 271/35 X |
| 3,151,863 | 10/1964 | Lohr | 271/35 X |
| 3,776,544 | 12/1973 | Watson et al. | 271/157 X |
| 3,984,659 | 10/1976 | Bilbrey | 271/35 X |

FOREIGN PATENT DOCUMENTS

| | | | |
|---|---|---|---|
| 133837 | 5/1989 | Japan | 271/34 |

*Primary Examiner*—Boris Milef
*Attorney, Agent, or Firm*—Frommer Lawrence & Haug LLP

[57] ABSTRACT

A brochure feeding unit comprises a feeding magazine containing brochures stacked on top of each other in the form of a stack. The lowermost brochure in the stack directly resting on a belt conveyor is withdrawn by means of the conveyor through an outlet side of the magazine. The remaining brochures in the feeding magazine are retained by a partition element. The brochure is withdrawn from the feeding magazine and is stopped against a locating member wherein the distance between the lower end of the locating member and belt conveyor defines a gauged passage clearance having a width greater than the nominal thickness of the back edge of the brochure. A pusher element movable along the locating member impinges upon the brochure back edge of the brochure in order to reduce the height of the back edge under the lower end of the locating member so that the brochure can pass through the gauged passage clearance.

38 Claims, 4 Drawing Sheets

1
2
3
3a
4
4'
5
7
7'
8
8a
8a
9
10
11
12
12
13
14
15
16
16a
17
17a
18
19
20
21
21a
22
"A"

UNIT AND METHOD FOR INDIVIDUALLY FEEDING BROCHURES TO A PICK-UP STATION

FIELD OF THE INVENTION

The present invention relates to a unit for individually feeding brochures to a pick-up station, and more particularly, to a unit for individually feeding brochures to pick-up station wherein a belt conveyor terminates at the pick-up station. The present invention also relates to a method for individually feeding brochures to a pick-up station.

In the embodiment described, the feeding unit is designed to be used in conjunction with an apparatus for packaging compact discs into respective cases. This feeding unit supplies the compact disc packaging apparatus with booklets, covers or leaflets (hereinafter collectively referred to as "brochures") to be inserted into the compact disc cases as a result of mechanical handling devices provided in the packaging apparatus.

BACKGROUND OF THE INVENTION

It is well-known that prior apparatus for the automatic packaging of compact discs include within their operating cycle insertion of booklets, covers, leaflets or the like into cases designed to receive the compact discs.

Usually feeding of these brochures is achieved with the aid of a belt conveyor by which the brochures are individually positioned close to a pick-up station where, by means of a mechanical handling device, the brochures are picked up to be conveniently fitted into the respective case.

Presently, placement down of the brochures onto the belt conveyor is performed manually by an operator assigned to assist with operation of the packaging machine.

More particularly, the operator, when it is necessary, places a number of brochures stacked on top of each other at the beginning of the longitudinal extension of the belt conveyor. The stacked brochures are distributed in a direction towards the pick-up station so that, when distribution is completed, each brochure projects towards the pick-up station with respect to the next one disposed immediately below.

The belt conveyor is then operated such that the brochures progress towards the pick-up station, until the pick-up station is reached by the first brochure in the stack.

The belt conveyor is then stopped in response to signals received from photoelectric cells or similar sensing devices positioned in the pick-up station, to thereby enable the handling device to pick up the first brochure. Thereafter, operation of the belt conveyor will be repeated so as to position the next brochure in the stack at the pick-up station.

However, these prior booklet insertion mechanisms have been found to have the following disadvantage.

First, the amount of brochures which can be disposed on the belt is closely related to the longitudinal extension of the belt conveyor. It is therefore difficult to obtain a sufficiently self-contained operation, especially in packaging machines of relatively small sizes, where the belt conveyor length is necessarily restricted. In addition, a correct distribution of the brochures on the belt requires a certain skill level of the operator.

Moreover, another disadvantageous aspect of the known art is the time required for periodically distributing the brochures on the belt conveyor, because, if an operator is performing this function, the operator will be unable to assist in the other operations of the packaging machine.

OBJECTS AND SUMMARY OF THE INVENTION

Accordingly, it is an object of the present invention to provide a method and apparatus for feeding brochures, such as booklets, covers or leaflets, to a belt conveyor which avoids the aforementioned disadvantages of the prior art.

An additional object of the present invention is to provide a method and apparatus for feeding brochure to a belt conveyor which enables the brochures to be sequentially fed onto the belt conveyor, by a respective feeding unit of reduced bulkiness, in a completely automatic manner.

Various other objects, advantages and features of the present invention will become readily apparent from the ensuing detailed description and the novel features will be particularly pointed out in the appended claims.

The foregoing and further objects are substantially achieved by a unit for individually feeding brochures to a pickup station which includes a feeding magazine arranged to receive a plurality of brochures disposed consecutively on top of each other in the form of a stack. In the feeding unit of the present invention, at least one of the brochures, disposed in a lowermost position in the stack, is in abutting relation with the belt conveyor such that the lowermost brochure can be withdrawn, upon the action of the conveyor, through an outlet side of the feeding magazine.

At least one locating member is supported above the belt conveyor and defines therewith a gauged passage clearance "Z" which is of a greater width than the nominal thickness "h" of each brochure. The locating member is arranged so as to interfere with the back edge of the brochure to stop progress of the brochure on the belt conveyor.

A presser member is operatively associated with the locating member and is arranged to exert a thrust action on the back edge of the brochure so as to elastically deform the brochure from a free condition, wherein the upper surface of the brochure at its back edge lies at a slightly higher level than a lower end of the locating member, to an elastic-yielding condition, wherein the upper surface of the brochure is positioned under the lower end of the locating member so that the brochure can be moved by the belt conveyor passing under the locating member.

Still, in accordance with the present invention, this feeding unit also provides a method of individually feeding brochures to a pick-up station wherein a plurality of brochures disposed consecutively on top of each other in the form of a stack are arranged inside a feeding magazine with at least one of the brochures located in a lowermost position in the stack being in abutting relation with a belt conveyor. The belt conveyor is operated for withdrawing at least the lowermost brochure in the stack through an outlet side of the feeding magazine. The movement of the brochure is then stopped against a locating member supported above the belt conveyor. This locating member defines in conjunction with the belt conveyor a gauged passage clearance "Z" of a greater width than the nominal thickness "h" of each brochure. A thrust action is then exerted on the back edge of the brochure so as to elastically deform the brochure from a free condition, wherein the upper surface of the brochure at the back edge thereof lies at a slightly higher level than the lower end of the locating member, to an elastic-yielding condition, wherein the upper surface of the brochure at the back edge thereof is positioned under the lower end of the locating member so that the brochure can be moved by the belt conveyor passing under the locating member.

BRIEF DESCRIPTION OF THE DRAWINGS

The following detailed description, given by way of example, will best be understood in conjunction with the accompanying drawings in which.

DETAILED DESCRIPTION OF CERTAIN PREFERRED EMBODIMENTS

Figure 1:
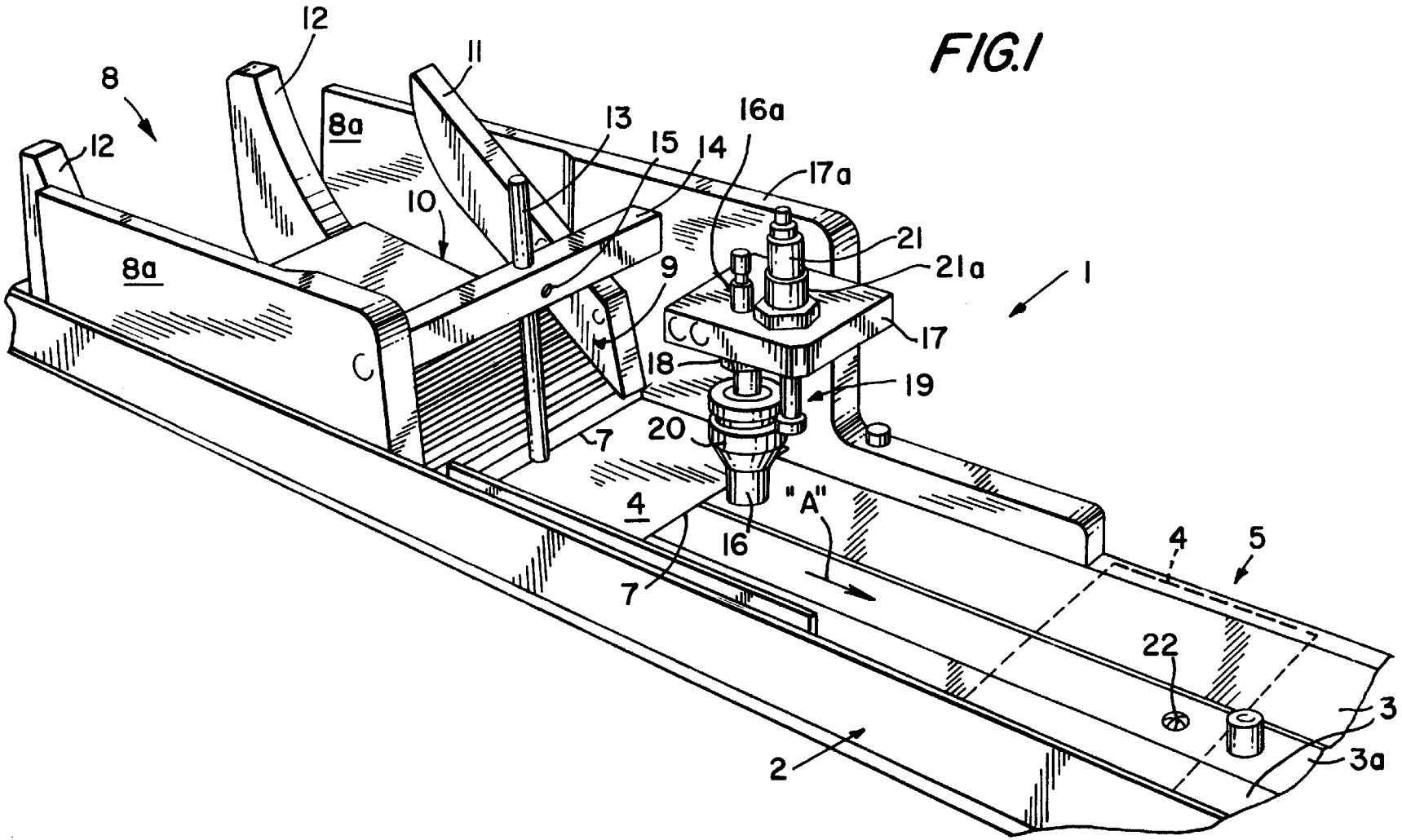
FIG. 1 is a perspective view of a preferred embodiment for a feeding unit for feeding brochures, such as booklets, to a pick-up station in accordance with the teachings of the present invention.

Referring now to the drawings, wherein like reference numerals are used throughout, and in particular to FIG. 1, there is illustrated a preferred embodiment of a unit for individually feeding brochures onto a belt conveyor in accordance with the present invention, which has been generally identified by reference numeral 1.

The feeding unit 1 includes a belt conveyor 2 which, in the embodiment shown, is used in conjunction with a machine for automatically packaging compact discs. This feeding unit 1 individually transfers brochures 4 to a pick-up station 5, wherein brochure 4 is picked up by a handling device (not shown) of the packaging machine (not shown).

The belt conveyor 2 includes one or more parallel endless belts 3 usually moved along a slide surface 3*a* according to a feed direction shown by arrow "A".

Figure 2:
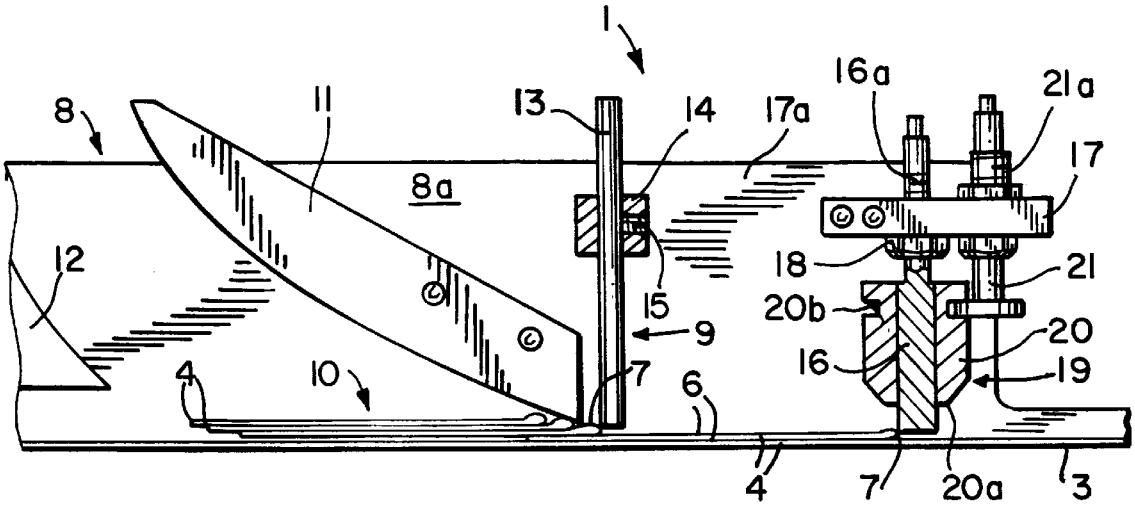
FIG. 2 is a side sectional view of the feeding unit of FIG. 1 specifically illustrating stoppage of a brochure against a locating member arranged on the belt conveyor, downstream of a feeding magazine.
Figure 3:
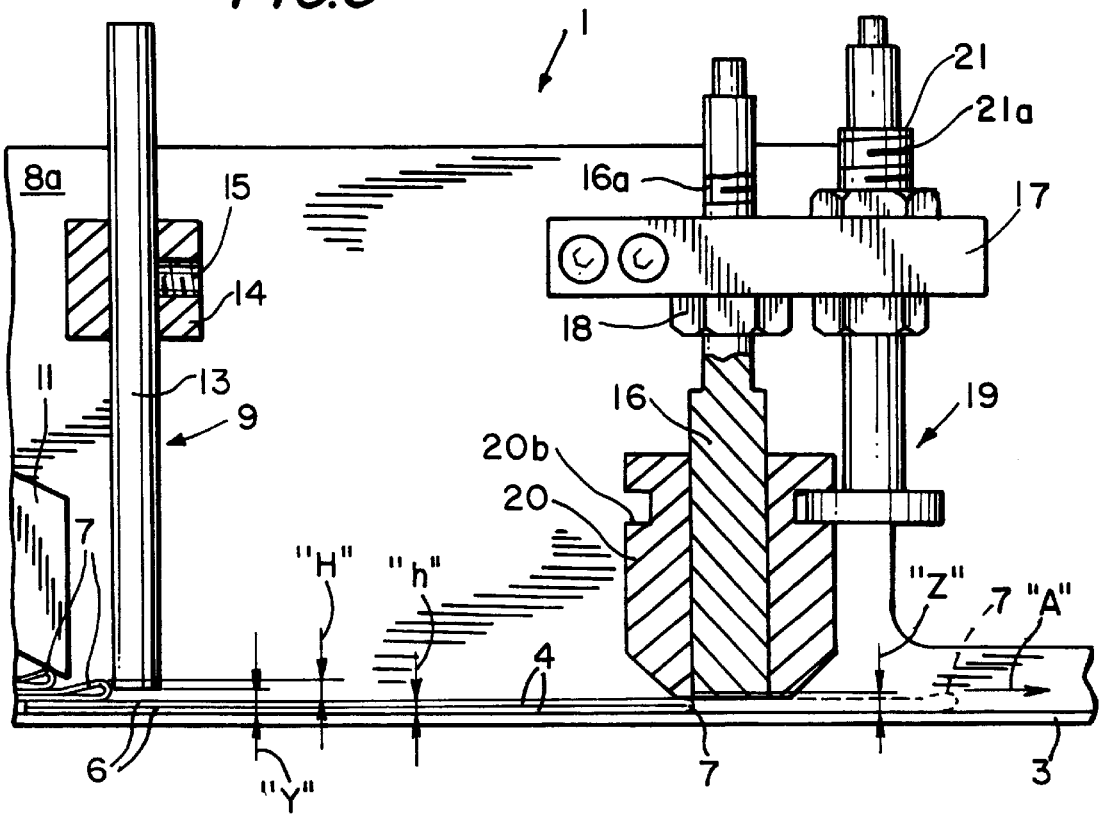
FIG. 3 is an enlarged side sectional view of the right-hand portion of the feeding unit of FIG. 2 specifically illustrating a pusher element associated with the locating member in an operating condition acting on the back edge of a brochure to enable passage of the brochure under the locating member.

In the embodiment illustrated in FIGS. 1 to 3, the unit 1 is arranged so as to be utilized in conjunction with brochures 4, such as booklets. In this case, each brochure 4 has at least two pages 6 disposed upon each other in mating relationship so that at least one sheet folded along a back edge 7 is oriented in the feed direction "A" (see FIGS. 3 and 4). Due to residual elasticity of the material forming the sheet, when the back edge is folded, the pages 6 at the back edge are not perfectly coupled against each other. Instead, at the back edge thereof, the pages 6 are slightly spaced apart.

Therefore, when a brochure 4 is in a free condition (that is, in the absence of external stresses, the pages 6 perfectly mate at the back edge 7 thereof), the height "H" (see FIG. 3) close to the back edge is greater than the nominal thickness "h", which is the sum of the page thicknesses when the pages 6 perfectly mate.

The feeding unit 1 is also provided with a feeding magazine 8 mounted on the belt conveyor 2 which includes at least two housing side walls 8a between which an outlet side 9 is defined, which is oriented in the feed direction "A" of the conveyor. The magazine 8 houses a plurality of brochures 4 having the respective back edges 7 facing the outlet side 9. In the magazine 8, the brochures 4 are consecutively placed on top of each other to form a stack generally denoted by 10. At least the lowermost brochure 4 in the stack 10 is directly in abutment with respect to the endless belts 3 of the belt conveyor 2 and therefore can be withdrawn from the magazine through the outlet side 9 upon operation of the belt conveyor.

Preferably, one or more guide elements 11 are fastened to the inner surfaces of the housing walls 8*a* of the magazine 8 and act on the upper part of the opposite side edges of the brochures 4 so as to obtain a curvilinear and/or substantially inclined orientation of the stack 10 in the magazine 8. This inclined orientation causes each brochure 4 to be slightly projected towards the outlet side 9 of the magazine 8 relative to the next brochure 4 placed immediately on top of it. The action of the guide element or elements 11 may be assisted advantageously by one or more auxiliary guide elements 12 adapted to act on the lower surfaces of the brochures' side edges.

Advantageously, at least one partition element 13 is operatively supported at the outlet side 9. The partition element 13 is formed of a rod passing through and removably fastened, according to a substantially vertical axis, to a horizontal support bar 14 secured between the housing walls 8*a* of the feeding magazine 8. Associated with the partition element or rod 13 is a positioning member which in the illustrated embodiment of FIG. 1 is in the form of a headless screw 15 operatively engaged through the support bar 14. This positioning member allows for the modification of the axial positioning of the rod so as to suitably adjust the width of an outlet port "Y" (see FIG. 3) defined between the lower end of the partition rod 13 and the belt conveyor surface, and more particularly, the endless belts 3 of the belt conveyor 2.

The width adjustment of the outlet port "Y" attempts to allow only a predetermined number of brochures 4 to simultaneously pass through the outlet side 9. More particularly, the width of this outlet port "Y" is preferably adjusted by an amount substantially corresponding to the height "H" at the back edge 7 of each brochure 4 in the free condition, so as to hinder the simultaneous passage of more than one brochure under the partition rod 13.

Downstream of the feeding magazine 8 along the belt conveyor and preferably at a distance "D" lower than the longitudinal dimension "L" of each brochure 4 is provided at least one locating member 16. The locating member 16 is supported above the belt conveyor 2 and is arranged to interfere with the back edge 7 of the brochure 4 emerging from the feeding magazine 8, to stop progress of that brochure on along the belt conveyor 2. Accordingly, when the back edge of each brochure encounters the locating member 16, the corresponding brochure 4 will be stopped and, since operation of the belt conveyor 2 continues, the endless belts 3 slide under the brochure.

More specifically, the locating member 16 substantially includes a rod-like element which is operatively connected, according to a substantially vertical axis, to a support bracket 17 formed integrally with the belt conveyor 2. In the embodiment shown in the figures, the support bracket 17 is rigidly linked to an extension 17*a* of one of the housing walls 8*a* of the feeding magazine 8.

Operatively associated with the rod-like locator 16 is an adjusting member for adjusting the distance between the lower end 16*b* of the locator and the belt conveyor 2. In a preferred embodiment, this adjusting member is formed of a threaded portion 16*a* disposed on the rod-like element forming the locator 16 and operating in engagement through the support bracket 17. Therefore, by rotating the rod-like element 16, the axial positioning of the rod-like element can be modified so that its lower end 16*b* can be moved close to or away from the belt conveyor 2.

Advantageously, the axial positioning of the rod-like element 16 is adjusted such that, between the lower end 16*b* of the rod-like element and the belt conveyor 2 (and more particularly, the work surface 3*b* of one of the endless belts 3) a gauged passage clearance "Z" is created (see FIG. 3). The width of the gauged passage clearance "Z" is greater than the nominal thickness "h" and preferably the width "Z" is between the thickness "h" and twice the thickness "h".

In addition, the width of the gauged clearance "Z" is set to be smaller than the height "H" (the height close to the back edge 7 of each brochure 4 in a free condition), to ensure that movement of each brochure 4 is stopped by the locating member 16.

Once the desired adjustment of the gauged clearance "Z" has been achieved, a locking nut 18 operatively fitted on the threaded portion 16*a* enables locking of the locating member.

Still in accordance with the present invention, operatively associated with the locating member 16 is a presser member 19 selectively operable to exert a thrust action against the back edge 7 of the brochure 4 while the brochure is stationary against the locating member. This presser member 19 preferably includes at least one pusher element 20 slidably guided along the rod-like element 16 which is selectively movable between a rest position, wherein the pusher element 20 is raised from the brochure 4 (see FIGS. 1 and 2), and an operating condition, wherein the pusher element 20 acts in thrust relation on the brochure back edge 7 (see FIG. 3).

When the pusher element 20 is in its operating condition, the thrust action exerted by it on the back edge 7 of the brochure 4 causes the simultaneous compaction of the pages 6 in the vicinity of the back edge. As a result thereof, the brochure 4 attains to a yielding condition in which the height at the back edge 7 is substantially identical with the nominal thickness "h", and in any case, is lower than the dimension of the gauged passage clearance "Z". In this yielding condition, the upper surface of the brochure 4 is positioned below the lower end 16*b* of the locating member 16 and the brochure is allowed to pass under the locating member 16, as a result of the dragging action exerted by the belt conveyor 2.

Preferably, the pusher element 20 has a cylindrical configuration with a tapered lower end, so that its end portion 20*a* of reduced size impinges upon the brochure 4, which ensures concentration of the thrust force on the back edge 7.

In addition and for the purposes of ensuring a correct dragging of the brochure 4 by the belt conveyor 2, the pusher element 20 is at least partly made of a material that when in contact with the brochure 4, provides a friction coefficient lower than that generated by the belt conveyor, and more particularly, the endless belts 3 of the belt conveyor.

Movement of the pusher element 20 occurs in response to the command of at least one fluid-operated actuator or another type of actuator 21 that, in a preferred embodiment, is actuated upon command of at least one photoelectric cell 22 or equivalent sensing device arranged in the pick-up station 5. This enables the transfer of a new brochure 4 to the pick-up station when the brochure previously disposed therein has been picked up by the handling device associated with the packaging machine.

In the embodiment shown, the fluid-operated actuator 21 is disposed in side-by-side relation with the locating member 16 and acts on the pusher element 20 at an annular groove 20*b* formed peripherally in the pusher element 20. Actuator 21 also has a threaded portion 21*a* which is operatively engaged through the support bracket 17. Therefore, the axial positioning of the actuator 21 can be modified by rotating it so as to adjust positioning of the pusher element 20 in its operating condition. Preferably, the adjustment occurs in such a manner that, in its operating condition, the pusher element 20 is stopped with its work portion 20*a* substantially flush with the lower end of the locating member 16, so as to prevent an undesirable large thrust force from being applied to the brochure 4.

The pusher element 20 is also capable of performing its function in an efficient manner in the event that two or more superimposed brochures 4 stop against the locating member 16. In fact, even if the pusher element 20 stops its stroke in its operating condition against the uppermost brochure 4, its thrust action will always be transmitted to the back edge 7 of the brochure 4 disposed on, and in direct contact with the belt conveyor 2. As such, the brochure in direct contact with the belt conveyor will consequently achieve a compacting condition.

Figure 5:
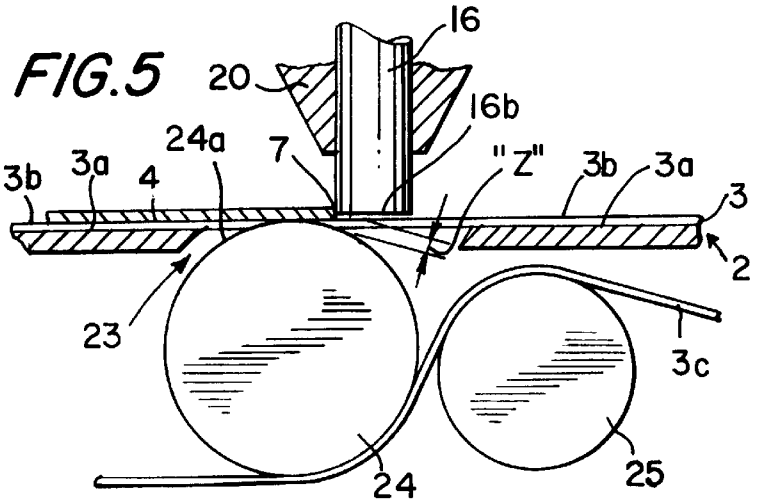
FIG. 5 is a partial enlarged side elevational view in section of the feeding unit of FIG. 4, specifically illustrating stoppage of a brochure against the locating member.
Figure 6:
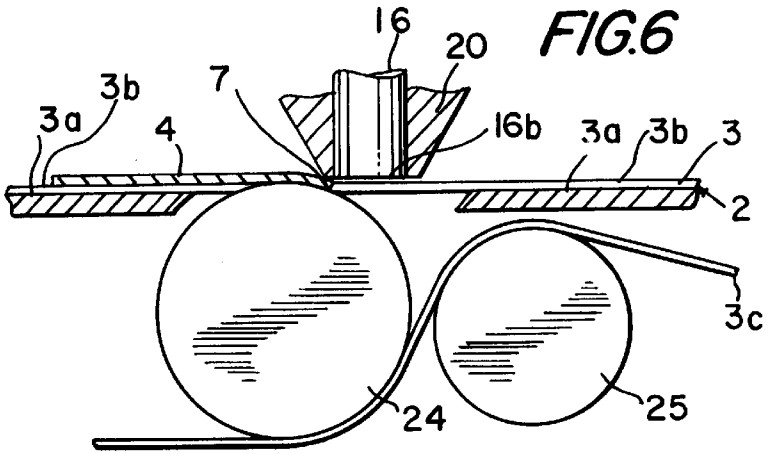
FIG. 6 is a partial enlarged side elevational view in section similar to the view of FIG. 5, specifically illustrating an operating condition in which the pusher element places the brochure at a position allowing for passage of the brochure under the locating member.
Figure 4:
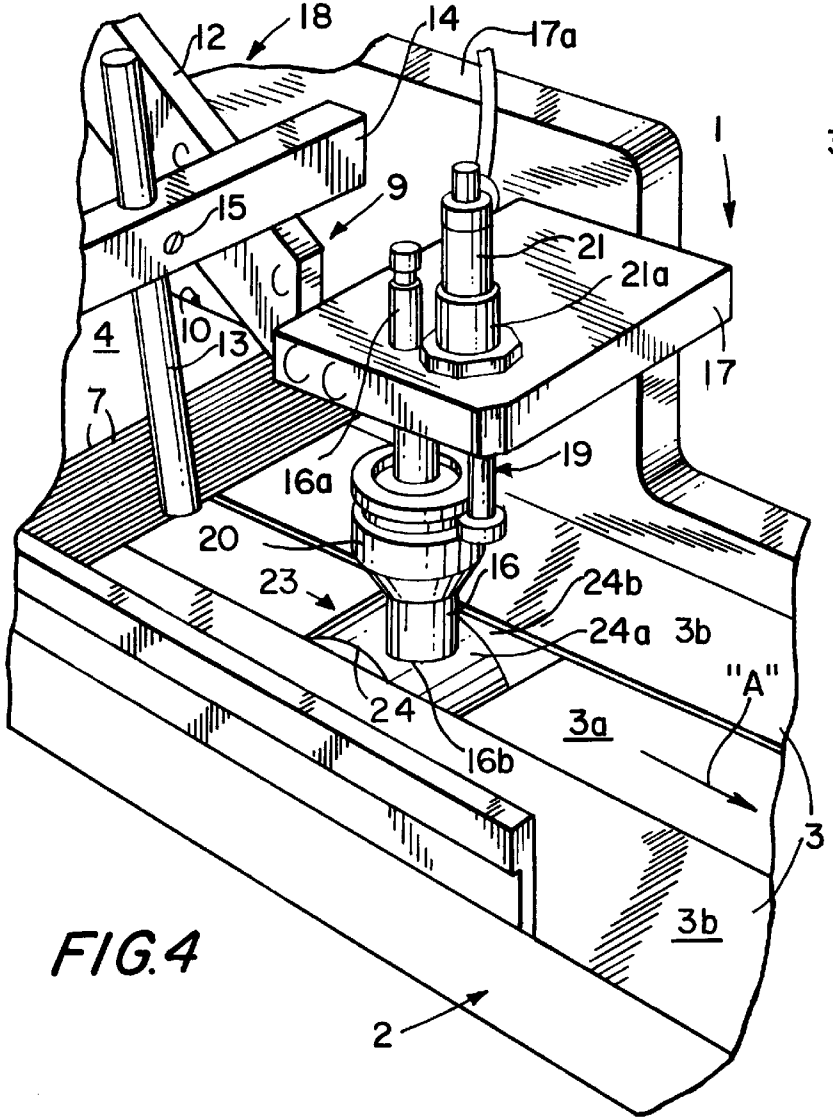
FIG. 4 is a partial front perspective view of another preferred embodiment of a feeding unit adapted to feed brochures, such as booklets, cover, or leaflets, to a pick-up station in accordance with the teachings of the present invention.

Referring now to FIGS. 4 through 6, another embodiment of a feeding unit in accordance with the teachings of the present invention adapted to perform feeding of brochures 4, such as booklets, covers or individual leaflets, is illustrated.

The components of the embodiment of the feeding unit of FIGS. 1 through 3 which are also present in the embodiment of FIGS. 4 to 6 have been designated by the same reference numerals in FIGS. 4 to 6. In the embodiment of FIGS. 4 through 6, a leveling member 23 associated with the belt conveyor 2 is arranged close to the locating member 16 to retain the back edge 7 of the brochure 4 slightly raised relative to the lower end 16*b* of the locating member. As a result of this leveling member 23, the brochure 4 emerging from the feeding magazine 8 is conveniently supported by the endless belts 3 such that the respective work surfaces 3*b* are at a slightly higher level than the slide surface 3*a*. The locating member 16, instead of operating above one of the belts 3 (as in the embodiment of FIGS. 1 to 3) is disposed in alignment with the slide surface 3*a*. As a result, its lower end 16*b* can be positioned to a level slightly underneath the work surfaces 3*b* of the belts 3 in order to efficiently engage or block the back edge 7 of the brochure 4 regardless of whether the brochure is a cover or an individual leaflet.

Preferably, at least one dragging roller 24 is also provided which is operatively disposed between the endless belts, according to an axis perpendicular to the feed direction "A".

Particularly, the roller 24 at its opposite ends has terminal portions 24*b* acting on the belts 3 and in contact relationship therewith so that the roller rotates upon operation of the belt conveyor 2. As shown in FIGS. 5 and 6, on the return stretches 3*c* of the belts 3, at least one pressure roller 25 may be arranged so as to ensure engagement of the return stretches with the dragging roller 24 in a wrapping arc orientation sufficient to ensure an efficient driving of the belts upon rotation of the roller.

In the region between the endless belts 3, the dragging roller 24 is provided with an operating surface 24*a* which acts on the pusher element 20 in opposite relationship therewith so as to facilitate dragging of the brochure 4 when the latter is in its yielding condition upon the action of the pusher element.

Advantageously, the operating surface 24*a* of the dragging roller 24 slightly projects on the upper side relative to the slide surface 3*a*, so as to assist or take the place of the endless belts 3 as a result of the leveling member 23, that is, to slightly raise the back edge 7 of the brochure 4 relative to the lower end 16*b* of the locating member 16.

As is best shown in FIGS. 5 and 6, the brochure 4 (either in the form of an individual leaflet, or in the form of a cover or a booklet) removed from the feeding magazine 8 stops against the locating member 16, with its back edge 7, in the middle portion of its extension, slightly raised from the underlying surface of the dragging roller 24. When the photoelectric cell 22 causes the fluid-operated actuator 21 to displace the pusher element 20 to its operating condition, the back edge 7 is elastically deformed such that the upper surface of the brochure 4 is positioned under the lower end 16*b* of the locating member 16. Due to the effect of the endless belts 3 and the dragging roller 24, the brochure 4 has the possibility of being dragged along through the passage clearance "Z" defined between the lower end 16*b* of the locating member 16 and the operating surface 24*a* of the dragging roller.

In this event as well, accumulation of two or more superposed brochures 4 against the locating member 16 does not cause malfunctions of the feeding unit 1, because the action of the pusher element 20 will always be transmitted to the brochure 4 located in the lowermost position, ensuring passage of the same through the gauged clearance "Z".

Figure 7:
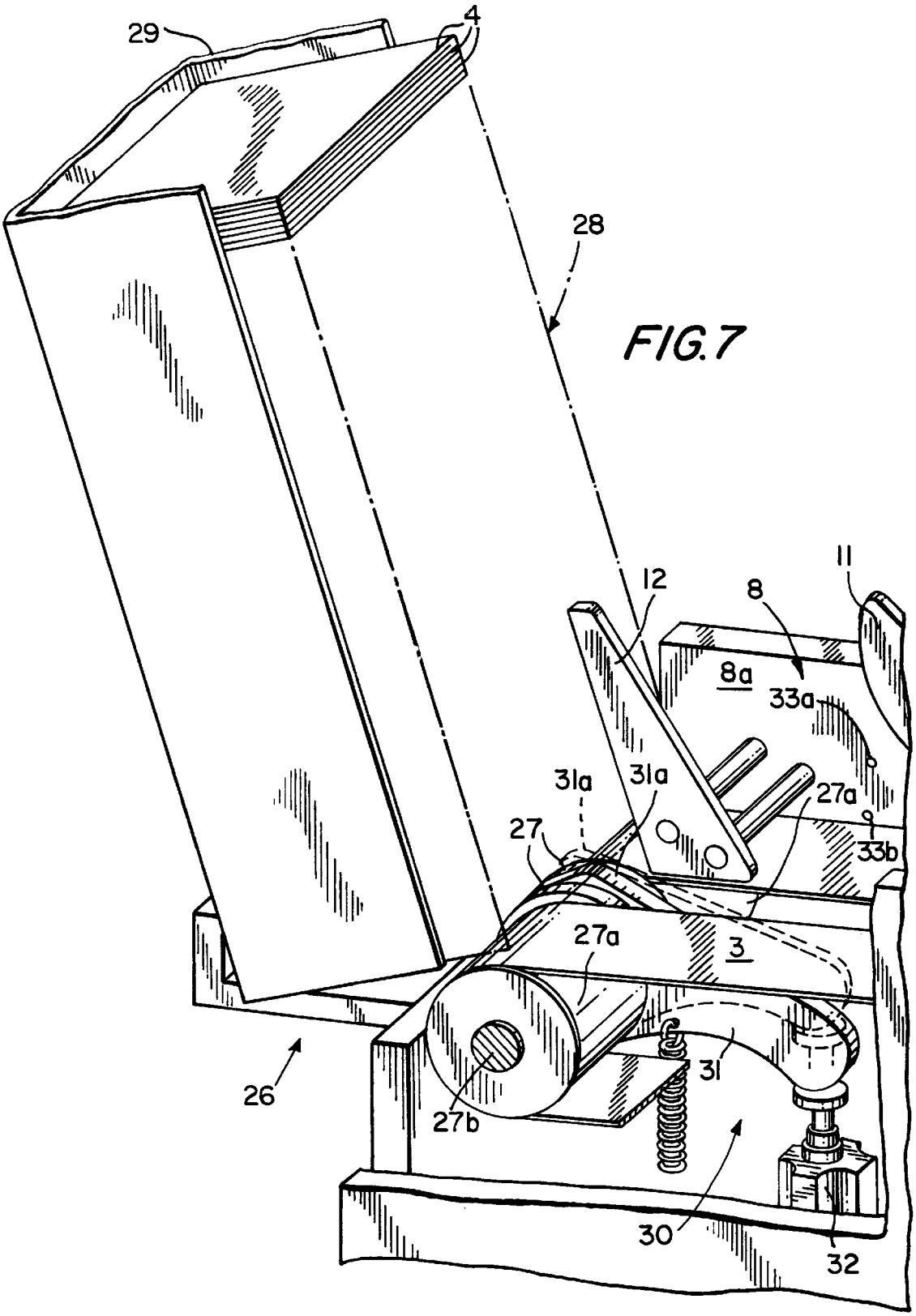
FIG. 7 is a front perspective view of a preferred embodiment of an auxiliary feeder to be optionally used in conjunction with the feeding unit of the present invention.

As is best shown in FIG. 7, an auxiliary feeder 26 may advantageously be associated with the feeding unit 1 for periodically supplying the feeding magazine 8 with a new stack 10 of brochures 4.

This auxiliary feeder 26 includes at least one extraction wheel 27 operatively disposed upstream of the feeding magazine 8 and operable in rotation according to a horizontal axis perpendicular to the feed direction "A". In a preferred embodiment, the extraction wheel 27 is advantageously comprised of one or more diametrical expansions formed on respective idler pulleys 27*a* coaxial with each other which are typically arranged at the end of the belt conveyor 2 to conveniently support and guide the endless belts 3. Concurrently with operation of the belt conveyor 2, dragging induced on the idler pulleys 27*a* by the endless belts 3 therefore causes rotation of the extraction wheel 24 at a peripheral speed greater than the movement speed of the belts themselves.

A stack 28 of brochures 4 stacked on top of each other and contained in a brochure holder or supply receptacle 29 is arranged on the extraction wheel 27. This brochure holder 29 extends in a substantially vertical direction, slightly inclined in a direction opposite to the feed direction "A". The brochure holder 29 may advantageously be formed of a box-shaped casing of the type usually used for transporting brochures 4, with an open side at its lower part thereof through which the extraction wheel 27 comes into contact with the lowermost brochure in the stack 28 of brochures 4.

As a result, upon rotation of the extraction wheel 27, the brochure 4 in contact therewith will be removed from the brochure holder 29 and thereby transferred to the feeding magazine 8.

Before the brochure 4 has completely left the brochure holder 29, a new brochure 4 comes into contact with the extraction wheel 27 and therefore begins to be removed as well from the holder. As a result thereof and also as a result of the lower displacement speed of the endless belts 3 relative to the peripheral speed of the extraction wheel 27, the brochures 4 are removed rapidly in succession from the holder 29 and laid down on the endless belts 3 on top of each other. In this manner the brochures 4 pile up against the partition element 13 thereby forming the stack 10 within the feeding magazine 8.

A shutoff mechanism 30 is provided to disable the dragging action of the extraction wheel 27 when a predetermined number of brochures 4 are present in the feeding magazine 8. The shutoff mechanism 30 also restores the dragging action when the magazine is depleted of brochures or the number of brochures falls below a preset level.

The shutoff member 30 is preferably comprised of at least one lifting lever 31 interposed between the idler pulleys 27*a* and is oscillatably engaged on a support axis 27*b* rotatably carrying the pulleys. An air cylinder 32 or similar means acts on the lifting lever 31 to selectively move the lever 31 between a rest position, wherein its work portion 31*a* is spaced apart from the brochures 4 housed in the brochure holder 29, and an operating position, wherein the work portion 31*a* acts on the lowermost brochure 4 in the stack 28 to maintain it in a position slightly raised from the extraction wheel 27 so that the wheel 27 can rotate freely without feeding any brochures to the magazine 8.

The air cylinder 32 acts in response to first and second photoelectric cells 33*a*, 33*b* or equivalent drive means associated with the feeding magazine 8 to operatively move the lifting level 31 to its rest or work positions respectively, when the height of the stack 10 is above or falls below a preset value.

In accordance with one of the general objects of the present invention, a method for feeding brochures to a pick-up station is also provided by the feeding unit 1 of the present invention. A description of this method follows.

The auxiliary feeder 26 or, in the absence of an auxiliary feeder, an operator assigned to assist in the operation of the packaging machine, supplies the feeding magazine 8 with a stack 10 of brochures 4, when required. By virtue of the presence of the guide elements 11, 12, the stack 10 is arranged in a substantially inclined or stepped configuration with the back side of each brochure 4 projecting towards the outlet side 9 of the magazine 8 relative to the immediately overlying brochure 4. The lowermost brochure 4 in the stack 10 is in abutting relationship with the belt conveyor 2, and more particularly, with the endless belts 3 of the conveyor so that it is ready to be dispensed through the outlet side 9 of the feeding magazine 8 upon movement of the conveyor. While one brochure 4 is being dispensed from the magazine 8, the brochures disposed on top of it are conveniently retained in the magazine by the partition element 13.

Before the removal of the brochure 4 through the outlet side 9 has been completed, movement of the brochure being removed is stopped against the locating member 16. The brochure 4 remains stationary against the locating member 16 until a signal is received from the photoelectric cell 22 that no brochure is present in the pick-up station 5, and as a consequence thereof, the fluid-operated actuator 21 is actuated. Following actuation of the actuator 21, the pusher element 20 exerts a thrust action on the back edge 7 of the brochure 4 such that the brochure achieves its yielding condition so that the brochure can be moved by the belt conveyor 2 passing under the locating member 16.

Operation of the conveyor belt 2 simultaneously causes the removal of a new brochure 4 from the feeding magazine 8 and stoppage of the same at the above-described stationary position against the locating member 16.

When the brochure 4 from the locating member 16 reaches the pick-up station 5, the belt conveyor 2 will be de-activated until the brochure is received by the handling device.

The present invention attains its intended purposes.

As a result of the design of the present invention, the feeding unit enables feeding of brochures onto a belt conveyor to be achieved in a completely automatic manner, which advantageously reduces the longitudinal extension of the conveyor in comparison to the known embodiments wherein brochure distribution along the conveyor belt was executed manually.

The invention therefore enables problems relating to a self-contained operation of the brochure-feeding devices to be alleviated. Those problems were predominant in packaging machines of relatively small sizes that, due to obvious bulkiness reasons, could not have a belt conveyor of a significant longitudinal extension.

The feeding unit of the present invention can also be readily adapted for use with brochures in a variety of forms, such as covers, leaflets or booklets, having a different number of pages and/or different thicknesses, by merely adjusting the width of the gauged passage clearance "Z" and the outlet port "Y".

While the present invention has been particularly shown and described with reference to certain preferred embodiments, it will be readily apparent to those of ordinary skill in the art that various changes and modifications may be made therein without departing from the spirit and scope of the invention. It is intended that the appended claims be interpreted as including the foregoing as well as various other such changes and modifications.

What is claimed is:

1. A unit for individually feeding brochures to a pick-up station, including a belt conveyor terminating at a pick-up station, the brochure feeding unit comprising:

a feeding magazine arranged to receive a plurality of brochures disposed in the form of a stack with the lowermost brochure in the stack in a position to be withdrawn from the magazine upon the actuation of the belt conveyor through an outlet side of the feeding magazine;

at least one locating abutment member supported above the belt conveyor and defining therewith a gauged passage clearance ("Z") having a width greater than the nominal thickness ("h") of each brochure, said locating abutment member being arranged so as to interfere with a back edge of the brochure to stop progress of the brochure along the belt conveyor; and presser means operatively associated with said locating abutment member for exerting a thrust action on the back edge of said brochure so as to elastically deform the brochure between a free condition, wherein the upper surface of the brochure at the back edge thereof lies at a slightly higher level than a lower end of the locating abutment member, and an elastic-yielding condition, wherein the upper surface of the brochure is positioned under the lower end of the locating abutment member so that the brochure can be moved by the belt conveyor passing under the locating abutment member wherein said presser means comprises at lease one pusher element slidably guided along said locating abutment member and is movable upon command of an actuator to deform the brochure between its said free and elastic-yielding conditions.

2. The brochure feeding unit as claimed in claim 1, wherein said gauged passage clearance ("Z") has a width which is less than the height adjacent to the back edge of each brochure in its free condition, each brochure comprising at least two pages defined by a sheet folded along said back edge, in the proximity of which back edge the brochure, in the absence of external stresses, has a height ("H") greater than the sum of the thicknesses of the individual pages of the brochure.

3. The brochure feeding unit as claimed in claim 1, wherein said gauged passage clearance ("Z") has a width which is between one and two times the sum of the thicknesses of the individual pages of each brochure.

4. The brochure feeding unit as claimed in claim 1, and further comprising at least one partition element operatively supported adjacent to the outlet side of the feeding magazine and defining with the belt conveyor an outlet port ("Y") to enable the simultaneous passage of a predetermined number of brochures towards said locating abutment member.

5. The brochure feeding unit as claimed in claim 4, wherein said outlet port ("Y") has a width substantially corresponding to the height of the back edge of each brochure in its free condition.

6. The brochure feeding unit as claimed in claim 4, wherein said partition element and said locating abutment member are positioned from each other at a first distance with the first distance being smaller than the longitudinal dimension of each brochure.

7. The brochure feeding unit as claimed in claim 4, wherein said partition element comprises at least one generally vertically-arranged rod removably fastened to a horizontal support bar secured to the feeding magazine adjacent to said outlet side.

8. The brochure feeding unit as claimed in claim 7, and further comprising positioning means for adjusting the width of the outlet port ("Y").

9. The brochure feeding unit as claimed in claim 1, wherein said locating abutment member comprises at least one stop element operative engaged with a support bracket formed integrally with the belt conveyor.

10. The brochure feeding unit as claimed in claim 9, and further including adjusting means for adjusting the width of said gauged passage clearance ("Z").

11. The brochure feeding unit as claimed in claim 10, wherein said adjusting means comprises a threaded portion disposed on said stop element and operating in engagement through said support bracket, said stop element being capable of rotation for modifying the width of the gauged passage clearance ("Z").

12. The brochure feeding unit as claimed in claim 9, wherein said pusher element is movable upon command of said actuator between a rest condition, wherein said pusher element impinges upon the back edge of the brochure, and an operating condition, wherein said pusher element impinges upon the back edge of the brochure, in thrust relation therewith, such that the brochure achieves its yielding condition.

13. The brochure feeding unit as claimed in claim 12, wherein said pusher element has a cylindrical configuration with a tapered lower end facing the belt conveyor.

14. The brochure feeding unit as claimed in claim 12, wherein said pusher element is at least partly made of a material, which when in contact with the brochure, has a friction coefficient which is less than the friction coefficient of said belt conveyor.

15. The brochure feeding unit as claimed in claim 12, wherein said actuator is operable in response to sensor means disposed in said brochure pick-up station for sensing the presence of brochures at the pick-up station.

16. The brochure feeding unit as claimed in claim 1, wherein said feeding magazine comprises one or more guide elements engaging the brochures at their respective side edges so as to impart to said stack a substantially inclined configuration in which each brochure projects towards the outlet side relative to the immediately overlying brochure.

17. The brochure feeding unit as claimed in claim 1, and further comprising an auxiliary feeder for periodically supplying brochures to the stack of brochures in the feeding magazine.

18. The brochure feeding unit as claimed in claim 17, wherein said auxiliary feeder comprises:

at least one extraction wheel operatively disposed upstream of the feeding magazine;

a brochure holder defining a supply receptacle, extending in a substantially vertical direction from the extraction wheel and housing a supply of said brochures, the lowermost one of said brochures in said stack being in abuttable relationship with the extraction wheel; and shutoff means for disabling and restoring the dragging action of the extraction wheel, respectively when a predetermined number of brochures are in the feeding magazine or when the number of said brochures falls below a preset level.

19. The brochure feeding unit as claimed in claim 18, wherein said extraction wheel comprises at least one diametrical expansion formed on a respective idler pulley disposed at one end of the belt conveyor.

20. The brochure feeding unit as claimed in claim 18, wherein said shutoff means comprises at least one lifting lever in oscillatory engagement with said belt conveyor and selectively movable between a rest position, wherein said lifting lever has a work portion spaced apart from the brochures housed in the brochure holder, and an operating position, wherein said work portion impinges on the lowermost brochure in said supply to retain the lowermost brochure raised from the extraction wheel.

21. A unit for individually feeding brochures, in which each of said brochures comprises at least two pages disposed upon each other in mating relation and defined by at least one sheet folded along a back edge close to which edge the brochure is in a free condition, when the brochure is free of external stresses, and has a height ("H") greater than the sum of the thicknesses of the individual pages of the brochure, said brochure feeding unit comprising:

a belt conveyor terminating at a pick-up station;

a feeding magazine arranged to receive a plurality of brochures disposed consecutively on top of each other to form a stack, at least one of said brochures being disposed in a lowermost position in said stack is in abuttable relation with the belt conveyor so as to be withdrawn from the magazine as a result of movement of the conveyor through an outlet side of said feeding magazine;

at least one locating abutment member supported above the belt conveyor and defining therewith a gauged passage clearance ("Z") having a width less than the height ("H") of the back edge of each brochure in its free condition, said locating abutment member being arranged so as to interfere with the back edge of the brochure to stop progress of the brochure on the belt conveyor; and presser means operatively associated with said locating abutment member for exerting a thrust action on the back edge of said brochure in order to elastically deform the brochure from its said free condition to a yielding condition wherein the height of the back edge is smaller than the dimension of said gauged passage clearance ("Z") so that the brochure can be moved by the belt conveyor passing under the locating abutment member, wherein said presser means comprises at least one pusher element slidably guided along said locating abutment member and is movable upon command of an actuator to deform the brochure between its said free and yielding conditions.

22. A method of individually feeding brochures to a pick-up station, said method comprising the steps of:

arranging a plurality of brochures disposed consecutively on top of each other in the form of a stack inside a feeding magazine such that at least one of said brochures located in a lowermost position in said stack is in abuttable relationship with a belt conveyor;

operating the belt conveyor for withdrawing at least said lowermost brochure through an outlet side of the feeding magazine;

stopping movement of the brochure against a locating abutment member supported above the belt conveyor wherein a gauged passage clearance ("Z") is defined between said locating abutment member and said belt conveyor which is of a greater width than the nominal thickness ("h") of each brochure; and slidably guiding at least one pusher element of presser means along said locating abutment member upon command of an actuator to exert a thrust action on the back edge of said brochure so as to elastically deform the back edge of the brochure from a free condition, wherein the upper surface of the brochure at the back edge lies at a slightly higher level than the lower end of the locating abutment member, to an elastic-yielding condition, wherein said upper surface is positioned under the lower end of the locating member so that the brochure can be moved by the belt conveyor passing under the locating abutment member.

23. The method as claimed in claim 22, and further comprising the step of retaining the brochures in the stack by means of a partition element except the brochure being withdrawn through the outlet side.

24. The method as claimed in claim 23, wherein stopping of the brochure against said locating abutment member occurs before the brochure is completely withdrawn from the outlet side of the feeding magazine.

25. The method as claimed in claim 22, wherein the brochure stack arranged in the feeding magazine is in a substantially inclined or stepped configuration with each brochure projecting in the direction of the outlet side with respect to the brochure disposed immediately above in the stack.

26. The method as claimed in claim 22, wherein the step of exerting a thrust action is achieved upon detection of the absence of brochures in a pick-up station defined along the belt conveyor downstream of said locating abutment element.

27. The method as claimed in claim 22, and further comprising the steps of:

arranging a supply of brochures upstream of the feeding magazine which are housed in a brochure holder;

transferring at least one brochure of said supply of brochures to the feeding magazine concurrently with operation of the belt conveyor; and stopping transferring of said brochures to the feeding magazine when a determined number of brochures are present in the feeding magazine.

28. The method as claimed in claim 27, wherein the transferring step is performed by arranging the lowermost brochure in said supply in abutting relation with an extraction wheel rotatable about a horizontal axis concurrently with operation of the belt conveyor.

29. The method as claimed in claim 28, wherein the step of stopping transferring of the brochures to the feeding magazine is performed by moving the lowermost brochure in said supply upwardly away from the extraction wheel.

30. A method of individually feeding brochures to a pick-up station with each of the brochures comprising at least two pages disposed upon each other in mating relation and defined by at least one sheet folded along a back edge wherein when the brochure is in a free condition clear of external stresses, the back edge has a height ("H") greater than the sum of the thicknesses of the individual pages of the brochure, said method comprising the steps of:

arranging a plurality of brochures disposed consecutively on top of each other in the form of a stack inside a feeding magazine with at least one of said brochures located at a lowermost position in said stack being in abuttable relation with a belt conveyor;

operating the belt conveyor for withdrawing at least said lowermost brochure through an outlet side of the feeding machine;

stopping movement of the brochure against a locating abutment member supported above the belt conveyor with the locating member and the belt conveyor defining a gauged passage clearance ("Z") of a width smaller than the height ("H") of the back edge of the brochure in its free condition; and slidably guiding at least one pusher element of presser means along said locating abutment member upon command of an actuator to exert exerting a thrust action on the back edge of said brochure in order to elastically deform the back edge from its free condition to a yielding condition in which the height of the back edge is smaller than the dimension of said gauged passage clearance ("Z") so that the brochure can be moved by the belt conveyor passing under the locating abutment member.

31. A unit for individually feeding brochures to a pick-up station, including a belt conveyor terminating at a pick-up station, the brochure feeding unit comprising:

a feeding magazine arranged to receive a plurality of brochures disposed in the form of a stack with the lowermost brochure in the stack in a position to be withdrawn from the magazine upon the actuation of the belt conveyor through an outlet side of the feeding magazine;

at least one locating member supported above the belt conveyor and defining therewith a gauged passage clearance ("Z") having a width greater than the nominal thickness ("h") of each brochure, said locating member being arranged so as to interfere with a back edge of the brochure to stop progress of the brochure along the belt conveyor and being comprised of at least one stop member operatively engaged with a support bracket formed integrally with the belt conveyor; and presser means operatively associated with said locating member for exerting a thrust action on the back edge of said brochure so as to elastically deform the brochure between a free condition, wherein the upper surface of the brochure at the back edge thereof lies at a slightly higher level than a lower end of the locating member, and an elastic-yielding condition, wherein the upper surface of the brochure is positioned under the lower end of the locating member so that the brochure can be moved by the belt conveyor passing under the locating member, wherein said presser means comprises at least one pusher element slidably guided along said stop element and movable upon command of an actuator between a rest condition, wherein said pusher element is raised from said brochure, and an operating condition, wherein said pusher element impinges upon the back edge of the brochure, in thrust relation therewith, such that the brochure achieves its yielding condition.

32. The brochure feeding unit as claimed in claim 31, wherein said pusher element has a cylindrical configuration with a tapered lower end facing the belt conveyor.

33. The brochure feeding unit as claimed in claim 31, wherein said pusher element is at least partly made of a material, which when in contact with the brochure, has a friction coefficient which is less than the friction coefficient of said belt conveyor.

34. The brochure feeding unit as claimed in claim 31, wherein said actuator is operable in response to sensor means disposed in said brochure pick-up station for sensing the presence of brochures at the pick-up station.

35. A unit for individually feeding brochures to a pick-up station, including a belt conveyor terminating at a pick-up station, the brochure feeding unit comprising:

a feeding magazine arranged to receive a plurality of brochures disposed in the form of a stack with the lowermost brochure in the stack in a position to be withdrawn from the magazine upon the actuation of the belt conveyor through an outlet side of the feeding magazine;

at least one locating member supported above the belt conveyor and defining therewith a gauged passage clearance ("Z") having a width greater than the nominal thickness ("h") of each brochure, said locating member being arranged so as to interfere with a back edge of the brochure to stop progress of the brochure along the belt conveyor;

presser means operatively associated with said locating member for exerting a thrust action on the back edge of said brochure so as to elastically deform the brochure between a free condition, wherein the upper surface of the brochure at the back edge thereof lies at a slightly higher level than a lower end of the locating member, and an elastic-yielding condition, wherein the upper surface of the brochure is positioned under the lower end of the locating member so that the brochure can be moved by the belt conveyor passing under the locating member; and an auxiliary feeder for periodically supplying brochures to the stack of brochures in the feeding magazine, wherein said auxiliary feeder comprises:

at least one extraction wheel operatively disposed upstream of the feeding magazine;

a brochure holder defining a supply receptacle, extending in a substantially vertical direction from the extraction wheel and housing a supply of said brochures, the lowermost one of said brochures in said stack being in abuttable relationship with the extraction wheel; and shutoff means for disabling and restoring the dragging action of the extraction wheel, respectively when a predetermined number of brochures are in the feeding magazine or when the number of said brochures falls below a preset level.

36. The brochure feeding unit as claimed in claim 35, wherein said extraction wheel comprises at least one diametrical expansion formed on a respective idler pulley disposed at one end of the belt conveyor.

37. The brochure feeding unit as claimed in claim 35, wherein said shutoff means comprises at least one lifting lever in oscillatory engagement with said belt conveyor and selectively movable between a rest position, wherein said lifting lever has a work portion spaced apart from the brochures housed in the brochure holder, and an operating position, wherein said work portion impinges on the lowermost brochure in said supply to retain the lowermost brochure raised from the extraction wheel.

38. A method of individually feeding brochures to a pick-up station, said method comprising the steps of:

arranging a plurality of brochures disposed consecutively on top of each other in the form of a stack inside a feeding magazine such that at least one of said brochures located in a lowermost position in said stack is in abuttable relationship with a belt conveyor;

operating the belt conveyor for withdrawing at least said lowermost brochure through an outlet side of the feeding magazine;

stopping movement of the brochure against a locating member supported above the belt conveyor wherein a gauged passage clearance ("Z") is defined between said locating member and said belt conveyor which is of a greater width than the nominal thickness ("h") of each brochure;

exerting a thrust action on the back edge of said brochure so as to elastically deform the back edge of the brochure from a free condition, wherein the upper surface of the brochure at the back edge lies at a slightly higher level than the lower end of the locating member, to an elastic-yielding condition, wherein said upper surface is positioned under the lower end of the locating member so that the brochure can be moved by the belt conveyor passing under the locating member;

arranging a supply of brochures upstream of the feeding magazine which are housed in a brochure holder;

transferring at least one brochure of said supply of brochures to the feeding magazine concurrently with operation of the belt conveyor by arranging the lowermost brochure in said supply in abutting relation with an extraction wheel rotatable about a horizontal axis concurrently with operation of the belt conveyor; and stopping transferring of said brochures to the feeding magazine when a predetermined number of brochures are present in the feeding magazine by moving the lowermost brochure in said supply upwardly away from the extraction wheel.

* * * * *